US007204097B2

(12) United States Patent
Sessa et al.

(10) Patent No.: US 7,204,097 B2
(45) Date of Patent: Apr. 17, 2007

(54) UPRIGHT REFRIGERATOR, PARTICULARLY, OF BUILT-IN TYPE WITH ANTI-DUST FILTER FOR THE COMPRESSOR COMPARTMENT, AND ANTI-DUST FILTER FOR THIS LATTER

(75) Inventors: Luigi Sessa, Comabbio (IT); Marco Zambon, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 76 days.

(21) Appl. No.: 11/063,904

(22) Filed: Feb. 23, 2005

(65) Prior Publication Data

US 2005/0183438 A1 Aug. 25, 2005

(30) Foreign Application Priority Data

Feb. 23, 2004 (IT) ..... MI20040063 U

(51) Int. Cl.
*F25B 39/04* (2006.01)

(52) U.S. Cl. ..... 62/428; 62/507; 55/357

(58) Field of Classification Search ..... 62/428–429, 62/507–508; 55/385.1, 481, 478, 357; 96/233
See application file for complete search history.

(56) References Cited

U.S. PATENT DOCUMENTS 2,197,120 A * 4/1940 Bergmann ..... 55/408
2,580,535 A * 1/1952 Emanuel ..... 62/285
2,811,840 A * 11/1957 Thompson ..... 62/302
4,047,393 A * 9/1977 Hanson et al. ..... 62/428

FOREIGN PATENT DOCUMENTS

| | | |
|---|---|---|
| JP | 5026562 | 2/1993 |
| JP | 2001/272158 | 10/2001 |
| WO | 9508087 | 3/1995 |

* cited by examiner

*Primary Examiner*—William E. Tapolcai
(74) *Attorney, Agent, or Firm*—Robert O. Rice; Stephen Krefman; John F. Colligan

(57) ABSTRACT

An upright refrigerator including a cabinet having in a lower position a compartment housing the usual compressor of the appliance refrigeration circuit. The compartment having an aperture at the rear in proximity to a rear wall of the cabinet and the cabinet comprising side walls having portions projecting from the bottom wall of the compartment supporting the compressor towards a surface on which the refrigerator rests. The cabinet having a cavity defined by the side walls of the cavity and the lower wall of the cabinet, between the lower wall and the bottom wall of the compartment there is a lower aperture below the usual door of the refrigerator, the lower aperture communicating with the aperture of the compartment. A filter member is removably positioned in the cavity to retain the impurities present in the air entering from the aperture of the lower wall of the cabinet and directed towards its rear aperture.

10 Claims, 1 Drawing Sheet

UPRIGHT REFRIGERATOR, PARTICULARLY, OF BUILT-IN TYPE WITH ANTI-DUST FILTER FOR THE COMPRESSOR COMPARTMENT, AND ANTI-DUST FILTER FOR THIS LATTER

BACKGROUND OF THE INVENTION

1. Field of the Invention

The present invention relates to an upright refrigerator, particularly of built-in type, in accordance with the introduction to the main claim.

2. Description of the Related Art

A built-in refrigerator is known to comprise a cabinet having at least one food preservation cavity provided with its own access door associated frontally with the cabinet. This cabinet presents a compartment for the usual refrigeration circuit compressor, the compartment being separate from the preservation cavity. The compartment comprises a bottom wall to which the compressor is fixed, the wall being spaced from a rear wall of the refrigerator cabinet by an aperture communicating with a lower cavity of the cabinet which spaces the bottom wall from a lower wall of the refrigerator cabinet, which itself is usually spaced from a surface on which the refrigerator is positioned. The cavity is bounded laterally by cabinet side walls which extend beyond the bottom wall of the compressor compartment, by a lower wall of the cabinet and rearward by the cabinet rear wall; this cavity presents at its front a aperture usually closed by a plinth having an aesthetic function. Finally, the lower wall of the cabinet is spaced from its rear wall to create an aperture for air access to the compressor compartment for its cooling.

In a built-in refrigerator of the stated type, the air may reach the compressor entraining with it impurities (such as dust) which can deposit on the compressor, on the condenser, on the electrical parts of the refrigerator or on those members of the refrigeration circuit adjacent to the compressor, to compromise its correct operation.

SUMMARY OF THE INVENTION

The present invention relates to a refrigerator in which the air reaching the compressor compartment is purified of the impurities collected during its passage below the refrigerator cabinet, in particular if this is built into a kitchen cabinet, hence avoiding the known problems of the state of the art linked to the deposition of the impurities onto the compressor, onto the condenser and onto those parts of the refrigeration circuit and refrigerator adjacent thereto.

Another embodiment of the invention is a refrigerator to which action can easily be taken to remove the collected impurities.

A further embodiment of the invention is a filter member for use in a refrigerator, advantageously of built-in type, which enables the aforesaid objects to be attained.

These and further embodiments which will be apparent to the person of ordinary skill in the art are attained by a refrigerator and a filter member in accordance with the accompanying claims.

DETAILED DESCRIPTION

Figure 1:
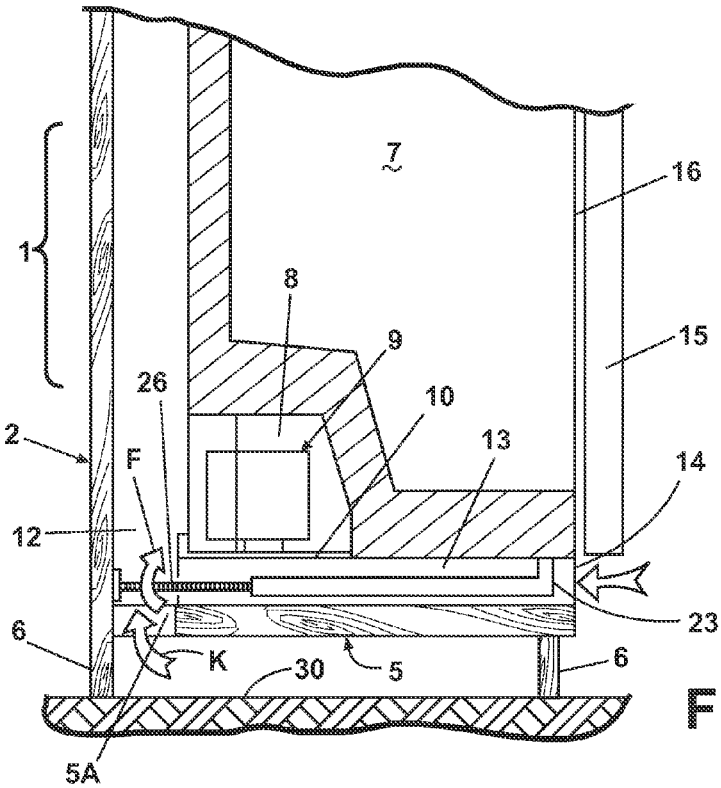
FIG. 1 is a partial schematic side section through a refrigerator of the invention.
Figure 2:
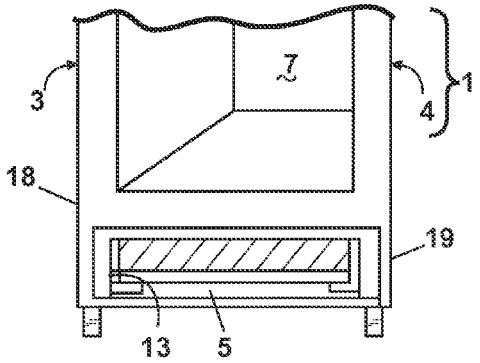
FIG. 2 is a front view of the lower part of the refrigerator of FIG. 1 with some parts omitted for greater clarity.
Figure 3:
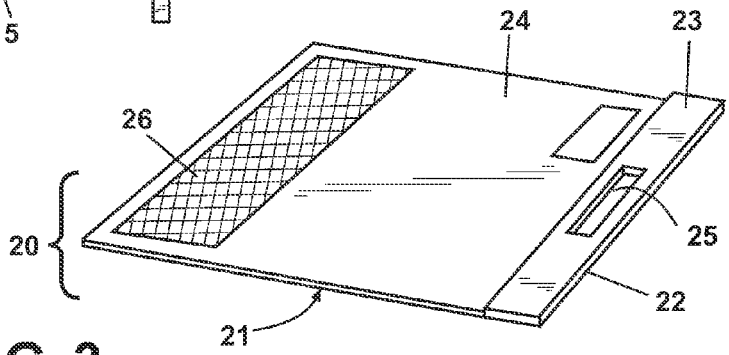
FIG. 3 is a perspective view of a filter member suitable for use in the refrigerator of FIG. 1.

FIG. 1 depicts a refrigerator according to the invention comprising a cabinet 1 having a rear wall 2, side walls 3 and 4, and a lower wall 5 spaced from the wall 2 to create an aperture 5A in the wall 5 in proximity thereto. Finally, usual support feet 6 for the cabinet 1 are present.

The refrigerator cabinet 1, of built-in type, comprises at least one usual food preservation cavity 7 below which there is a compartment 8 for a usual compressor 9 (shown schematically in FIG. 1) fixed to a bottom wall 10 of the compartment. The bottom wall 10 is spaced from the rear wall 2 of the refrigerator cabinet 1 to define therewith an aperture 12 and an interspace A in which the condenser (not shown) is contained.

Below the bottom wall 10, between it and the lower wall 5 of the cabinet 1, there is a cavity 13 open frontally at 14 below a panel 15 which closes the front access aperture 16 of the food preservation cavity 7 in usual manner and is associated in known manner with a door (not shown) of the refrigerator 1. The cavity 13 is bounded laterally by portions 18 and 19 of the side walls 3 and 4 of the cabinet 1 which project from the bottom wall 10 of the compressor compartment 8.

The portions 18 and 19 of the side walls 3 and 4 present, in the interior of the cavity (i.e. on those sides thereof facing the cavity), opposing guides (not shown) for supporting a filter member 20; this latter can be slidingly inserted into the cavity 13 or extracted from it via its front aperture 14. The filter member 20 (which divides the cavity 13 into two superposed parts) comprises a substantially flat body 21 having, at that end 22 thereof which is intended to face the aperture 14, a shoulder 23 projecting from its upper flat face 24. The shoulder 23 substantially closes that part of the cavity 13 between the filter member 20 and the overlying end wall 10 of the compressor compartment 8, and presents a recess 25 in the shape of a handle to facilitate gripping and movement of the member 20 along the guides of the portions 18 and 19.

The body 21 also comprises a filtering portion 26 arranged to lie between the apertures 12 and 5A. This filtering portion 26 is formed using a known filter, for example of activated carbon or of polyester of washable or preferably replaceable type.

By virtue of the invention, the air has free access to the compressor compartment 8 and to the interspace via the aperture 12, which it reaches from the aperture 5A after passing between the lower wall 5 of the refrigerator cabinet 1 and a surface 30 on which the cabinet 1 rests via its support feet 6; the air passes (see arrow K of FIG. 1) through the filtering portion 26 of the member 20 which retains dust entrained by it. Further air can reach the compressor compartment 8 from the cavity 13 (arrow F of FIG. 1) after entering through its front aperture 14, flowing between the flat body 21 of the filter member 20 and the lower wall 5 of the cabinet 1 and passing through the filtering portion 26 of the member 20.

The air which hence reaches the compartment 8 is purified of dust and other impurities, hence preventing these depositing on electrical or mechanical members usually located in the compartment, in particular on the condenser, and compromising their correct operation.

The filter member 20 can also be removed from the cavity 13 to enable the filtering portion to be periodically washed or replaced.

The aperture 14 can also be closed by a known plinth if no air circulation through the cavity 13 is desired.

An embodiment mainly related to a built-in refrigerator has been described. However, the invention can also be applied to a refrigerator not of built-in type.

We claim:

1. An upright refrigerator comprising:

a cabinet having in a lower position a compartment housing a compressor of an appliance refrigeration circuit, the compartment having a first aperture at the rear in proximity to a rear wall of the cabinet through which air enters the compartment;

a cavity provided below the compartment and closed by a lower wall of the cabinet, the cavity having a second aperture below a usual door of a preservation cavity of the cabinet and communicating with the compartment via the lower aperture; and a filter member for retaining the impurities present in the air entering the compartment and removably contained within the cavity and positioned at least in correspondence with the first aperture;

wherein the cavity is seperated into two parts by the filter member, communication between the compartment and the second aperture of the cavity being intercepted by a shoulder provided on the filter member.

2. The upright refrigerator of claim 1, wherein the filter member further comprises:

a substantially flat body having at least one filtering portion positioned in correspondence with the first aperture.

3. The upright refrigerator of claim 2, wherein the cavity comprises opposing guides for removably supporting the filter member.

4. The upright refrigerator of claim 1, wherein the shoulder comprises a recess enabling the filter member within the cavity to be gripped and moved.

5. The upright refrigerator of claim 2, wherein the lower wall of the cabinet is spaced from a surface on which the refrigerator rests and presents a rear aperture which is close to the rear wall of the cabinet and is located in correspondence with the first aperture of the compartment, the filter member being positioned between the rear aperture and the first aperture of the compartment.

6. The upright refrigerator of claim 2, wherein the filtering portion is washable.

7. The upright refrigerator of claim 2, wherein the filtering portion is replaceable.

8. The upright refrigerator of claim 1, wherein the filter member further comprises:

a gripping element for its movement.

9. The upright refrigerator of claim 8, wherein the gripping element is a recess provided in the shoulder.

10. The upright refrigerator of claim 2, wherein the shoulder is provided on a flat face of the body of the filter member.

* * * * *